US010820642B2

(12) United States Patent
Fudem

(10) Patent No.: US 10,820,642 B2
(45) Date of Patent: Nov. 3, 2020

(54) GARMENT ACCESSORY ATTACHMENT MECHANISM

(71) Applicant: Wolfie Furs Inc., Montreal (CA)

(72) Inventor: Larry Fudem, Hampstead (CA)

(73) Assignee: Wolfie Furs Inc., Montreal (CA)

( * ) Notice: Subject to any disclaimer, the term of this patent is extended or adjusted under 35 U.S.C. 154(b) by 507 days.

(21) Appl. No.: 15/355,925

(22) Filed: Nov. 18, 2016

(65) Prior Publication Data

US 2017/0273376 A1 Sep. 28, 2017

Related U.S. Application Data

(60) Provisional application No. 62/312,774, filed on Mar. 24, 2016.

(51) Int. Cl.

| | |
|---|---|
| ***A41D 27/08*** | (2006.01) |
| ***A41D 5/00*** | (2006.01) |
| ***A42B 1/04*** | (2006.01) |
| ***A44B 99/00*** | (2010.01) |

(52) U.S. Cl.

CPC ..... *A41D 27/08* (2013.01); *A41D 5/00* (2013.01); *A41D 5/006* (2013.01); *A42B 1/048* (2013.01); *A44B 99/00* (2013.01)

(58) Field of Classification Search

CPC .... A41D 27/08; A41D 5/006; Y10T 24/3431; Y10T 24/3439; A44B 99/00

USPC ..... 40/636, 640, 661.04, 662, 666; 63/29.2, 63/29.1

See application file for complete search history.

(56) References Cited

U.S. PATENT DOCUMENTS

| | | | | | |
|---|---|---|---|---|---|
| 1,299,244 | A | | 4/1919 | Sherwin | |
| 1,570,917 | A | | 1/1926 | Orent | |
| 3,466,663 | A | | 9/1969 | Mehl | |
| 3,479,667 | A | | 11/1969 | Mehl | |
| 3,882,549 | A | | 5/1975 | Gaburo | |
| 4,922,553 | A | | 5/1990 | Morrone | |
| 5,359,734 | A | * | 11/1994 | Rathbum | A42B 1/248 2/195.1 |
| 5,416,928 | A | | 5/1995 | Koenig | |
| 5,454,120 | A | * | 10/1995 | Rowlands | A42B 1/248 2/195.1 |
| 5,717,999 | A | | 2/1998 | Lurry | |

(Continued)

FOREIGN PATENT DOCUMENTS

| | | | |
|---|---|---|---|
| DE | 102008047403 | A1 | 3/2009 |
| EP | 2580973 | B1 | 8/2015 |

(Continued)

*Primary Examiner* — Khoa D Huynh
*Assistant Examiner* — Brieanna Szafran
(74) *Attorney, Agent, or Firm* — Price Heneveld LLP

(57) ABSTRACT

A garment attachment assembly is provided. The assembly includes a plurality of garment attachment modules each having an elongated support member, a garment attachment provided on an inner side of the support member, an accessory attachment provided on the outer side of the support member, and a coupling mechanism for coupling adjacent supports in an end-to-end configuration. Adjacent garment attachment modules can thus be coupled to adjust an overall length of the garment attachment assembly to fit a garment, and allow an accessory to be attached thereto. Corresponding method for securing an accessory to a garment is also provided.

17 Claims, 6 Drawing Sheets

(56) References Cited

U.S. PATENT DOCUMENTS

| | | | | |
|---|---|---|---|---|
| 8,453,267 | B1 | 6/2013 | Stanley | |
| 8,869,314 | B2 * | 10/2014 | Peper | A41F 15/02 2/244 |
| 9,173,440 | B1 * | 11/2015 | Crouch | A41F 15/02 |
| 9,259,055 | B1 * | 2/2016 | Raynor | A43C 7/04 |
| 2002/0160142 | A1 | 10/2002 | Nakai | |
| 2005/0198724 | A1 | 9/2005 | Steitle et al. | |
| 2007/0083971 | A1 | 4/2007 | Scully | |
| 2007/0271683 | A1 | 11/2007 | McCrary et al. | |
| 2009/0049719 | A1 | 2/2009 | Compton et al. | |
| 2010/0293695 | A1 | 11/2010 | Falvey | |
| 2010/0293700 | A1 | 11/2010 | Gillespie et al. | |
| 2011/0191943 | A1 | 8/2011 | Johnson et al. | |
| 2012/0324631 | A1 | 12/2012 | Peper et al. | |
| 2015/0250238 | A1 | 9/2015 | Garcia | |
| 2015/0289629 | A1 * | 10/2015 | Nakamura | A45F 3/04 36/136 |
| 2015/0342275 | A1 | 12/2015 | Rahban et al. | |

FOREIGN PATENT DOCUMENTS

| | | | |
|---|---|---|---|
| FR | 2985640 | A1 | 7/2013 |
| WO | 2002094045 | A1 | 11/2002 |
| WO | 2013171128 | A1 | 11/2013 |

* cited by examiner

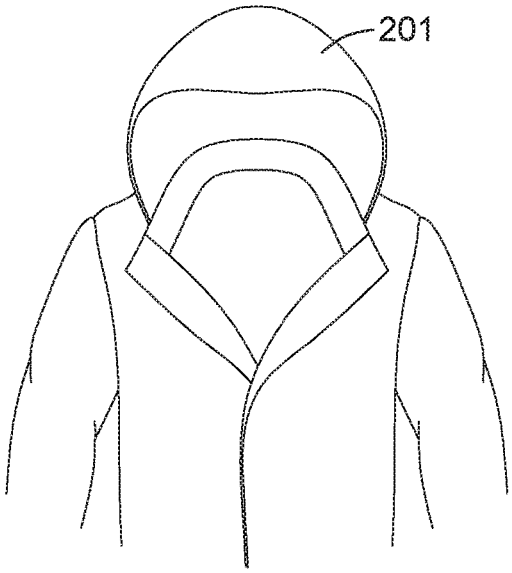
FIG. 5A
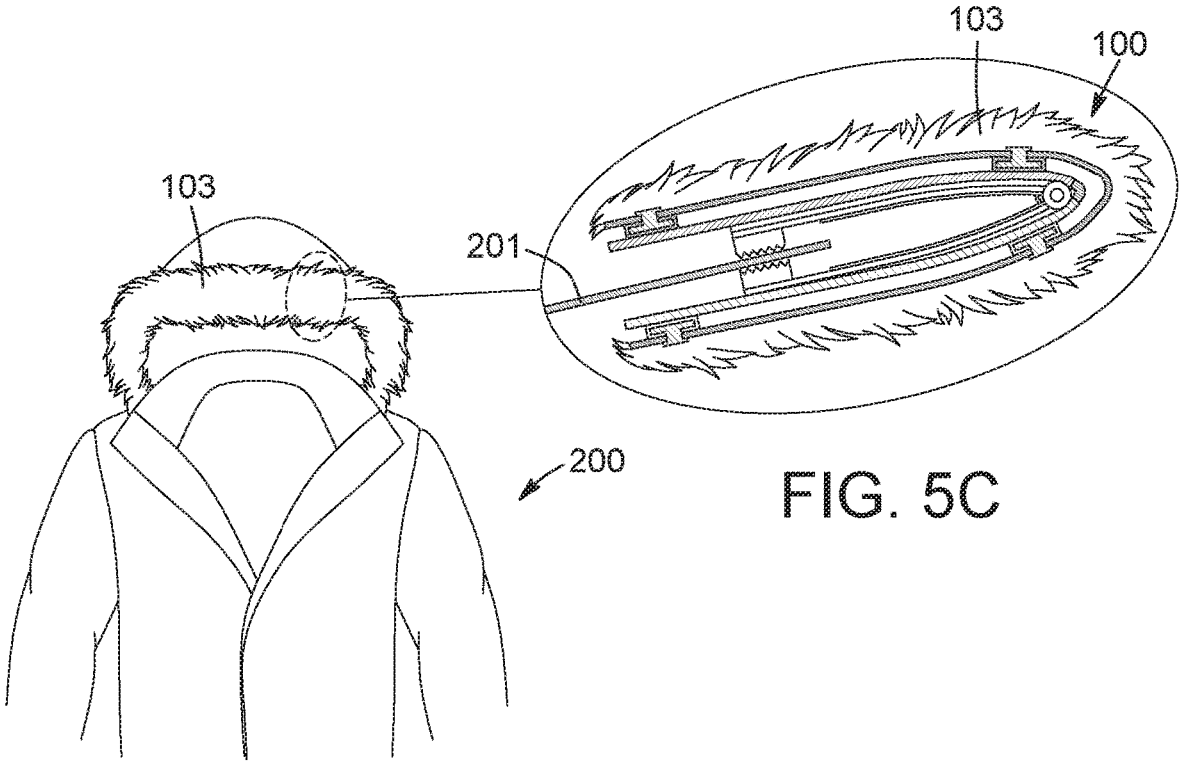
FIG. 5C
FIG. 5B

GARMENT ACCESSORY ATTACHMENT MECHANISM

TECHNICAL FIELD

The technical field generally relates to garment accessories. More particularly, it relates to a modular mechanism for attaching accessories to garments of different sizes.

BACKGROUND

In many garments, it is desirable to have a mechanism which allows for the removable attachment of accessories. Such a mechanism is advantageous to the wearer, as it offers improved customizability. For example, the wearer can have the option to remove accessories or replace them with accessories which are more suited to his or her style.

Disadvantageously, many existing mechanisms require that the removable accessory be tailor made to the garment to which it is to be attached. For example, detachable fur collars are generally attached to coats via a zipping or buttoning mechanism. In order for a fur collar to be attached to a coat, a zipper or button pattern must be sewn into the collar and must correspond to a zipper or button pattern sewn in the coat. The fur collar can therefore only be used with the coat, and cannot be used with another coat if that coat does not have the exact same button or zipper pattern.

It is therefore desired to have an improved accessory attachment mechanism which alleviates or improves upon at least some of the disadvantages of the prior art.

SUMMARY

According to an aspect, a garment attachment assembly is provided for attaching an accessory having an exposed side and a hidden side to a garment. The garment attachment assembly includes a plurality of garment attachment modules, each garment attachment module including: an elongated support member extending between first and second ends, and having an outer side and an inner side; a garment attachment provided on the inner side to removably secure the inner side of the support member on a portion of the garment; an accessory attachment provided on the outer side to removably secure the hidden side of the accessory on the outer side of the support member; and a coupling mechanism in at least one of the first and second ends of the support member, for coupling the first or second end of the support member to the first or second end of the support member of an adjacent garment attachment module, whereby coupling adjacent garment attachment modules allows adjusting an overall length of the garment attachment assembly to fit a length of the portion of the garment.

In an embodiment, the coupling mechanism includes a flexible tether extending between the garment attachment module and an adjacent garment attachment module, thereby allowing the garment attachment module and the adjacent garment attachment module to pivot relative to one another while maintaining a maximum separation distance between their ends.

In an embodiment, the tether includes a stretchable material.

In an embodiment, the coupling mechanism is positioned to maintain the accessory attachment in the garment attachment module in alignment with the accessory attachment in the adjacent garment module.

In an embodiment, the accessory attachment includes a track member for slideably engaging with a corresponding track member on the hidden side of the accessory.

In an embodiment, the track member includes a male or a female rail extending lengthwise along the outer side of the support member between the first and second ends, for slideably engaging with a corresponding male or female track member on the hidden side of the accessory.

In an embodiment, the rail is open in at least the first or second end for initiating the slideable engagement with the track member on the hidden side of the accessory.

In an embodiment, the male or female rail is closed in the first or second end, thereby obstructing the track member on the hidden side of the accessory from sliding along the rail past the first or second end.

In an embodiment, the elongated support member is a top panel, and the garment attachment module further includes a bottom panel foldable relative to the top panel via a hinge.

In an embodiment, the top and bottom panels have respective inner and outer sides, and the top and bottom panels are foldable along the hinge between an open position where the top and bottom panels extend away from one another, and a closed position in which the top and bottom panels extend substantially parallel to one another with the inner sides of the top and bottom panels facing one another.

In an embodiment, the garment attachment assembly further includes a biasing mechanism operatively connected to the top and bottom panels to bias the top and bottom panels towards the closed position.

In an embodiment, the garment attachment assembly further includes an accessory attachment on the outer side of the bottom panel.

In an embodiment, the garment attachment includes a clamping mechanism positioned between the top and bottom panels when in the closed position.

In an embodiment, a length of at least one of the garment attachment modules differs from a length of at least another one of the garment attachment modules coupled thereto.

In an embodiment, the support member is made from a rigid plastic.

According to an aspect, a garment attachment module is provided for attaching an accessory having an exposed side and a hidden side to a garment. The garment attachment module includes: an elongated support member extending between first and second ends, and having an outer side and an inner side; a garment attachment provided on the inner side to removably secure the inner side of the support member on a portion of the garment; an accessory attachment provided on the outer side to removably secure the hidden side of the accessory on the outer side of the support member; and a coupling mechanism in at least one of the first and second ends of the support member, for coupling the first or second end of the support member to the first or second end of a support member of an adjacent garment attachment module, whereby coupling adjacent garment attachment modules allows adjusting an overall length of the garment attachment assembly to fit a length of the portion of the garment.

According to an aspect, a garment accessory assembly securing an accessory to a garment is provided. The garment accessory assembly includes: a plurality of garment attachment modules coupled together in an end-to-end configuration, each garment attachment module including: an elongated support member extending between first and second ends, and having an outer side and an inner side; a garment attachment on the inner side securing the inner side of the support member on a portion of the garment; an accessory attachment on the outer side securing the accessory to the outer side; and a coupling mechanism coupling the first or second end of the support member to the first or second end of an adjacent support member; and a garment accessory secured to each of the plurality of garment attachment modules, and superposed thereon to hide the same, the garment accessory including: an exposed side facing away from the garment; and a hidden side superposed on the garment attachment modules, the hidden side including a support attachment engaged with the respective accessory attachments in each of the plurality of garment attachment modules.

According to an aspect, a method for attaching a garment accessory to a garment is provided. The method includes the steps of: providing a plurality of elongated support members, each support member extending between first and second ends and having an outer side and an inner side; coupling the plurality of support members in an end-to-end configuration to form an attachment assembly with a length matching a length of a portion of the garment; removably securing the attachment assembly to the portion of the garment, by clamping each of the plurality of support members to the portion of the garment, with their inner side superposed on the portion of the garment, and their outer side facing away from the garment; superposing the garment accessory on the outer sides of the support members, thereby completely hiding the attachment assembly under the garment accessory; and securing the garment accessory to the attachment assembly in the superposed arrangement of step d), the garment accessory thereby being secured to the garment via the attachment assembly.

In an embodiment, securing the garment accessory to the attachment assembly includes sliding a track member in the accessory successively along correspondingly-shaped track members in each of the support members.

In an embodiment, removably securing the attachment assembly to the portion of the garment includes folding top and bottom panels of the support members over the portion of the garment, with the top panel superposed on a top side of the portion of the garment, and the bottom panel superposed on a bottom side of the portion of the garment.

According to an aspect, a mechanism for attaching an accessory to a garment is provided. The mechanism includes an attachment assembly including at least one support attachable to a portion of the garment. In an embodiment, the support includes top and bottom panels foldable relative to one another, and a clamping mechanism for securing the support to the portion of the garment. In some embodiments, at least one of the top and bottom panels is permanently fixed to the accessory. In other embodiments, at least one of the top and bottom panels is provided with an attachment mechanism shaped to removably engage with a corresponding attachment mechanism provided in the accessory. In an embodiment, the attachment mechanism in the at least one of the top and bottom panels includes at least one track extending along a length of the panel. In an embodiment, the track is a female track with an open end for receiving a corresponding male portion of the attachment mechanism in the accessory. In an embodiment, the attachment assembly includes a plurality of supports removably connectable to one another. In an embodiment, each of the plurality of supports includes a tether with a flexible connection for flexibly connecting adjacent supports.

According to an aspect, a kit for forming an attachment assembly is provided. The kit includes a plurality of supports as described above. In an embodiment, the kit includes supports of at least two different lengths. In an embodiment, the two different lengths include approximately 2 inches and approximately 4 inches. In an embodiment, each of the supports includes a tether for flexibly connecting to an adjacent support, and allowing adjacent supports to be spaced apart by a maximum predetermined distance. In an embodiment, the maximum predetermined distance is approximately ¼ inch. In an embodiment, the kit includes at least one shell for covering a bottom panel of at least one of the supports. In an embodiment, the kit includes at least one accessory for attaching to the attachment assembly. In an embodiment the accessory is a hood or a collar. In an embodiment, the at least one accessory includes a decorative material such as fur, leather, shearling or other man made materials.

According to an aspect, a method for attaching an accessory to a garment is provided. The method includes the steps of providing an attachment assembly as described above and folding panels of a support of the attachment assembly over a portion of the garment. In some embodiments, the accessory is attached directly to the support. In other embodiments, the method includes an additional step of attaching the accessory to the attachment assembly. In an embodiment, the attachment assembly is attached to a collar of a coat. In an embodiment, the attachment assembly is attached to a lapel of a coat. In an embodiment, the attachment assembly is attached to a hood of a coat. In an embodiment, the method further includes the step of assembling the attachment assembly by tethering a plurality of supports as described above. In an embodiment, the method further includes the step of sliding a track of the accessory through corresponding tracks in the supports of the attachment assembly. In an embodiment, the method further includes the step of attaching a shell to a bottom panel of at least one of the supports.

According to an aspect, a garment accessory is provided. The accessory includes a support with a top side and a bottom side. The top side of the support is provided with a decorative material while the bottom side of the support is provided with an attachment mechanism shaped to removably engage with a corresponding attachment mechanism provided in an attachment assembly. In an embodiment, the decorative material includes fur, leather, shearling or other man made materials. In an embodiment, the attachment mechanism includes a track extending along a length of the accessory. In an embodiment, the track is a male track. In an embodiment, the attachment mechanism includes a plurality of pins protruding from the bottom side of the support. In an embodiment, the pins have a male configuration complementary in shape to a track provided in an attachment assembly.

The objects, advantages and other features of the present system will become more apparent upon reading of the following non-restrictive description of optional configurations thereof, given for the purpose of exemplification only, with reference to the accompanying drawings.

BRIEF DESCRIPTION OF THE DRAWINGS

FIGS. 5A to 5C are schematics illustrating a method for attaching a fur accessory to a coat hood using an attachment assembly having a support with fur attached to a top panel and a bottom panel thereof.

DETAILED DESCRIPTION

Generally speaking, the present disclosure provides an improved mechanism for attaching accessories to garments. In the described embodiments, an accessory can be attached to a garment via a universal support. In this fashion, the accessory does not need to be tailored specifically to the garment. In some embodiments, the accessory is removably engaged with the universal support. In this fashion, the universal support can be adapted to fit the garment, and a generically-shaped accessory can be attached to the support.

In the following description, the same numerical references refer to similar elements. For the sake of simplicity and clarity, namely so as to not unduly burden the figures, certain reference numbers are not included in some figures when the features they represent can be easily inferred from other figures. The embodiments, geometrical configurations, materials mentioned and/or dimensions shown in the figures or described in the present description are preferred embodiments only, given for exemplification purposes only.

Figure 1A:
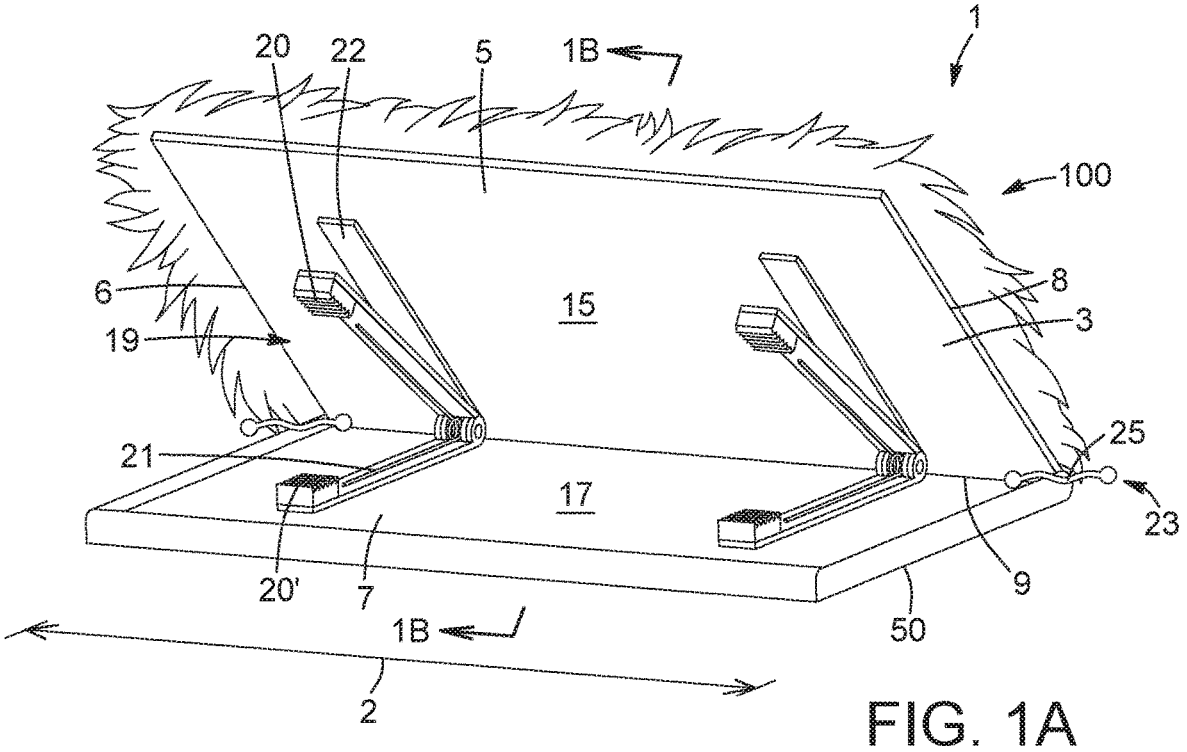
FIG. 1A is a perspective view of a garment accessory attachment mechanism according to an embodiment.
Figure 1B:
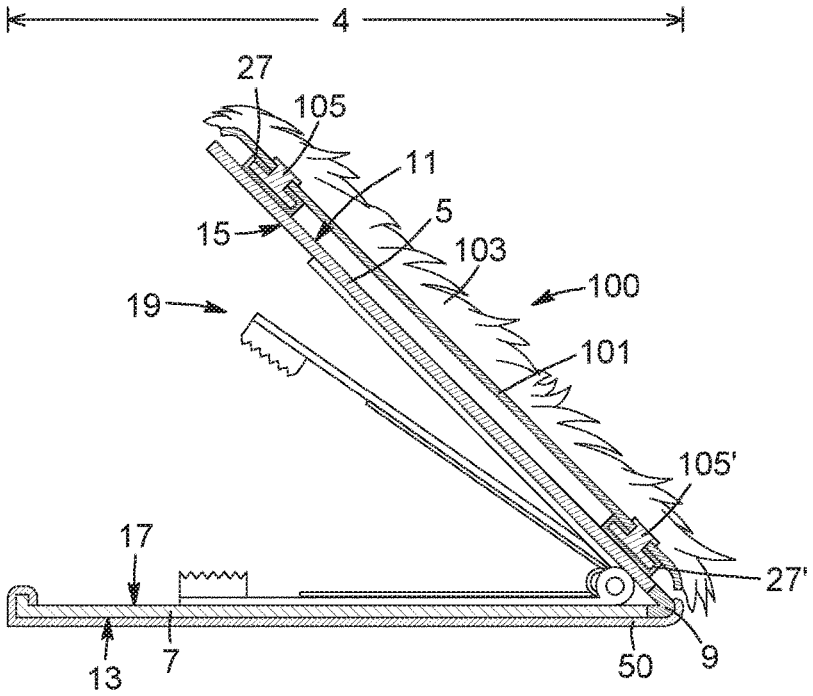
FIG. 1B is a cross-sectional view thereof.

With reference to FIGS. 1A and 1B, a garment accessory attachment mechanism is shown according to an embodiment. The attachment mechanism comprises an attachment module 1 including a support member 3 for securing to a portion of a garment. The support member 3 is elongated in that it extends along a longitudinal axis between first 6 and second 8 ends, and has a length 2 greater than its width 4. In the present embodiment, the support member 3 is a folding element (also referred to as a "binder") and is configured to fold onto itself in order to clamp onto a portion of a garment, such as a collar, lapel or cuff. Although in the present embodiment the support 3 is described as a folding element, it should be appreciated that other configurations, the support 3 does not necessarily need to be foldable, and that it can be secured to a portion of a garment using different mechanisms.

In the present embodiment, the support member 3 is a top panel 5, and the module 1 further includes a bottom panel 7. Preferably, top 5 and bottom 7 panels are made from a rigid material, such as PVC plastic. In this configuration, the panels 5 and 7 can serve as a rigid support or base for attaching accessories. However it is appreciated that in other embodiments, the material of the top 5 and/or bottom 7 panels can vary. For example, the top panel 5, bottom panel 7, or both, can be made of a flexible material, such as a fabric or mesh, or from a semi-rigid material such as flexible plastic, for example to conform to the curvatures of a portion of a garment to which they will be attached.

Top 5 and bottom 7 panels are foldable relative to one another via a hinge 9. In this configuration, the top 5 and bottom 7 panels are movable between an open position in which panels 5 and 7 extend away from one another, and a closed position in which panels 5 and 7 extend substantially parallel to one another. In the closed position, panels 5 and 7 define a space in which a portion of garment can be secured. Although in the present embodiment top 5 and bottom 7 panels are movable relative to one another, in other embodiments the panels 5 and 7 can be fixed. For example, the hinge 9 can be rigid, and the top 5 and bottom 7 panels can be held in a closed configuration, defining a space or cavity into which a portion of the garment can be slid and retained. Moreover, although referred to as "panels" it is appreciated that the top 5 and bottom 7 panels are not necessarily rectangular pieces, and can take different shapes. For example, top panel 5 can be shaped as a thin rectangular piece, whereas bottom panel 7 can comprise a plurality of distinct narrow clamping members spaced apart along a length of the top panel 5.

In the illustrated embodiment, top panel 5 comprises an outer side 11 and an inner side 15. Similarly, bottom panel 7 comprises an outer side 13 and an inner side 17. Outer sides 11 and 13 are said to be "outer" in that they face away from one another when the top 5 and bottom 7 panels are folded together. As can be appreciated, the outer sides 11 and 13 define outward-facing surfaces to which accessories can be attached. Meanwhile, inner sides 15 and 17 are said to be "inner" in that they face one another when the top 5 and bottom 7 panels are folded together. As can be appreciated, a portion of a garment can be held between the inner sides 15 and 17.

Preferably, inner sides 15 and 17 work together in order to clamp a portion of a garment therebetween in order to secure the support 3 to the garment. For example, the inner sides 15 and 17 can clamp opposite sides of a segment of fabric, such as a segment of fabric which forms a collar or a lapel on a coat. In the illustrated embodiment, in order to adequately secure the support 3 to the garment, inner sides 15 and 17 comprise a clamping mechanism 19.

In the present embodiment, the clamping mechanism includes complementary-shaped teeth 20, 20' respectively positioned adjacent the top and bottom inner sides 15, 17 for engaging opposite sides of a segment of fabric. Preferably, clamping mechanism 19 includes an inward biasing element 22 for biasing teeth 20, 20' and/or panels 5, 7 towards one another and effecting a strong clamping action on the segment of fabric. In the present embodiment, biasing element 22 comprises a lever which forces teeth 20, 20' together when engaged. Preferably, lever 22 is configured so that it engages only once it has been closed past a critical angle. For example, in the present embodiment, lever 22 is engaged with top panel 5. When top panel 5 is in the open configuration, the teeth 20, 20' are unbiased and can move freely to be positioned on opposite sides of a piece of fabric. When top panel 5 is moved towards the closed position, lever 22 eventually reaches a critical angle, causing the clamping mechanism to engage and clamp the teeth 20, 20' together. Preferably, clamping mechanism 19 further includes an outward biasing element 21, such as a spring, for biasing the teeth 20, 20' away from one another. In this configuration, teeth 20 and 20' are maintained away from one another when the clamping mechanism is open, thereby making it easier to position a segment of fabric between the teeth 20, 20'. It is appreciated that although in the present embodiment a clamping mechanism 19 with teeth 20, 20' is described, other types of mechanisms are possible for securing the support 3 to a segment of fabric. For example, a wide range of clips, clamps, or other suitable fabric engagement mechanisms, along with any combination thereof, can also be used. These engagement mechanisms can further be embedded or integral to the top 5 and/or bottom 7 panels, or can be removably engaged therewith. Moreover, the biasing elements 21 and 22 can be varied, and can employ other biasing mechanisms, such as magnets for example. In addition to biasing elements 21 and 22, closure elements can be provided for retaining the support 3 in the closed position.

In the illustrated embodiment, once the support 3 is engaged with a portion of a garment, the support 3 can act as a base for removably attaching accessories such as a hood, collar, cuff, trim, or other decorative element. In order to attach accessories, support 3 is preferably provided with an attachment mechanism which is complementary to an attachment mechanism provided in the accessory to be attached. In the illustrated embodiment, the outer side 11 of the top panel 5 is provided with a female attachment member. Female attachment member comprises a female track member 27 which in the present embodiment is a rail which extends along a length of the support 3. The female track 27 is complementary in shape to a male attachment member, such as a male track member 105, provided in a fur collar accessory 100. Preferably, female track 27 has an open end for receiving the male track 105 of the fur accessory 100. In this fashion, the fur accessory 100 can be attached by sliding the male track 105 through the open end and along the length of the female track 27. It is appreciated that the complementary shapes of the tracks 27, 105 allow for a longitudinal displacement of the support 3 and accessory 100 (i.e. the support 3 and accessory 100 can slide relative to one another along their lengths), while preventing a lateral displacement of the support 3 and accessory 100 (i.e. support 3 and accessory 100 are secured from relative displacement in directions perpendicular to their lengths.)

Figure 6A:
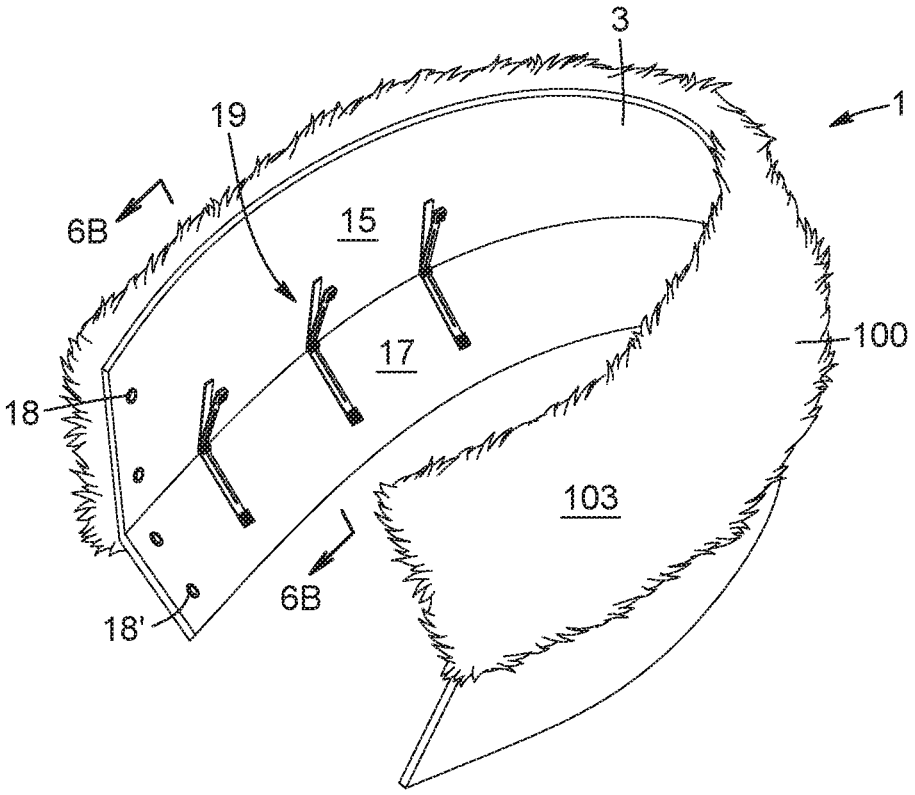
FIGS. 6A and 6B are respective perspective and cross-sectional views of a garment attachment mechanism according an embodiment where a fur accessory is permanently attached to the support of the attachment assembly.
Figure 6B:
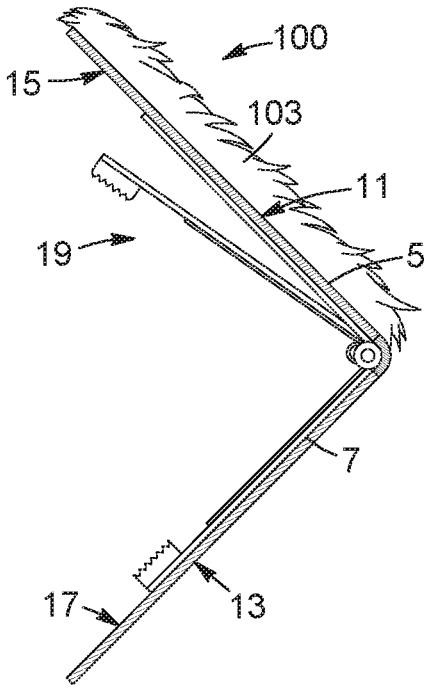

In alternate embodiments, for example as illustrated in FIGS. 6A and 6B, accessory 100 can be permanently attached to support 3 instead of providing corresponding removable attachment mechanisms in the accessory 100 and support 3. In such embodiments, support 3 can comprise panels 5 and 7 which are made of a fabric or mesh. Preferably, panels 5 and 7 are made of a stretchable fabric and can comprise an elastic, for example to allow the panels 5 and 7 to conform to contours of a portion of a garment. In the present embodiment, the accessory 100 is a trim for a collar, and panels 5 and 7 are stretchable to allow the assembly 1 to take the shape of an arc and thus conform to the shape of a coat collar. Fur 103 or other decorative material can be sewn or otherwise permanently affixed to outer side 11 of top panel 5, outer side 13 of bottom panel 7, or both. A suitable clamping mechanism 19 can be sewn or otherwise affixed to the inner sides 15, 17 of top and bottom panels 5 and 7. Moreover, corresponding closure elements 18, 18' such as buttons or magnets for example, can be provided on the inner side 15, 17 in order to hold top 5 and bottom 7 panels together once in the closed position.

Referring back to the embodiment of FIGS. 1A and 1B, top panel 5 is provided with two female tracks 27, 27' which extend substantially parallel to one another along opposite sides of the top panel 5. Preferably, the tracks 27, 27' are spaced apart, for example to provide improved stability. The female tracks 27, 27' engage with corresponding parallel male tracks 105, 105' extending along the length of the fur accessory 100, also preferably spaced apart for stability. In this fashion, the support 3 and accessory 100 can be securely attached to one another. It is appreciated, however, that other configurations of the track are also possible, so long as the track permits a secure yet removable attachment of support 3 and accessory 100. For example, more or fewer tracks can be provided, the cross-sectional shape of the tracks can vary, the male-female relationship of the tracks can be reversed, etc. In some embodiments, the track element of one of the panel 5 or accessory 100 can be a rail, whereas the track element in the other one of the panel 5 or accessory 100 can be a corresponding male or female pin or protrusion (or a plurality of pins), the pin being sized and shaped to slide along the rail. In the present embodiment, the tracks 27, 105 run substantially straight, but in other embodiments they can be slightly curved to prevent undesirable slide-out when the support 3 and accessory 100 are engaged. Similarly, in the present embodiment, an interface between the tracks 27, 105 is smooth to promote sliding, however in alternate embodiments, at least a portion of the tracks can be textured to prevent sliding. For example, an interior of the female tracks 27 can be textured near an end of the support 3, thereby providing increased friction to prevent further sliding of the accessory once it has been slid along track 27 to the end of the support 3. In the present embodiment, the track elements are shown as protruding from the panel 5 or accessory 100, however it is appreciated that other configurations are possible. For example, the track element can be a rail which is formed as a trough or recess in the body of the panel 5 or accessory 100. Moreover, in addition to track 27, 105, additional attachment mechanisms can be provided to prevent sliding once the accessory 100 is in position. For example, corresponding snapping elements, magnetic elements, adhesive elements, or the like can be provided on support 3 and accessory 100, allowing the accessory and support 3 to be locked together once slid into the proper position.

Although in the present embodiment reference is made to complementary tracks 27, 105, it is appreciated that other types of attachment mechanisms are also possible to allow for the removable attachment of an accessory 100 to the support 3. For example, instead of tracks, the accessory 100 and support 3 can be attached via hook-and-loop fasteners, such as Velcro™, via magnetic fasteners, or the like. Preferably, the attachment mechanism should be selected such that it is a universal attachment mechanism. In other words, it should permit attaching support 3 and accessory 100 regardless of their lengths, (for example by not relying on precise placement of fasteners along a length of the support 3 or accessory 100).

In the illustrated embodiment, the outer side 13 of bottom panel 7 is covered with a removable shell accessory 50. The removable shell 50 is preferably made from a flexible plastic or rubber, such as silicone, and is complementary in shape to a form of the outer side 13. In this fashion, the shell 50 can be removably engaged with the bottom panel 7, and can serve to protect the panel 7 and/or to cover the panel 7 with a more aesthetically appealing pattern. The shell 50 can be produced in a variety of different patterns, allowing a user to select a desired look for the underside of the support 3.

Although in the present embodiment, bottom panel 7 is shown as being engaged with a shell 50, it is appreciated that, in other embodiments, the bottom panel can also be configured to engage with an accessory 100. For example, as illustrated in FIG. 5C, bottom panel 7 can be provided with an attachment mechanism, such as tracks, on its outer side 13 for engaging with the accessory 100. A single accessory 100, in this case a fur trim for a hood, can engage with both the top 5 and bottom panels 7 simultaneously, and wrap around the outer side of hinge 9, thereby fully enveloping the support 3. In some embodiments, however, top 5 and bottom 7 panels can each engage with respective accessories 100. When both top 5 and bottom 7 panels are provided with attachment mechanisms, shell 50 can also serve to cover the attachment mechanism in the top 5 or bottom 7 panel if it is not in use. For example, if a fur accessory 100 is attach to top panel 5 only, the attachment mechanism in bottom panel 7 can be covered and protected by shell 50.

Figure 2A:
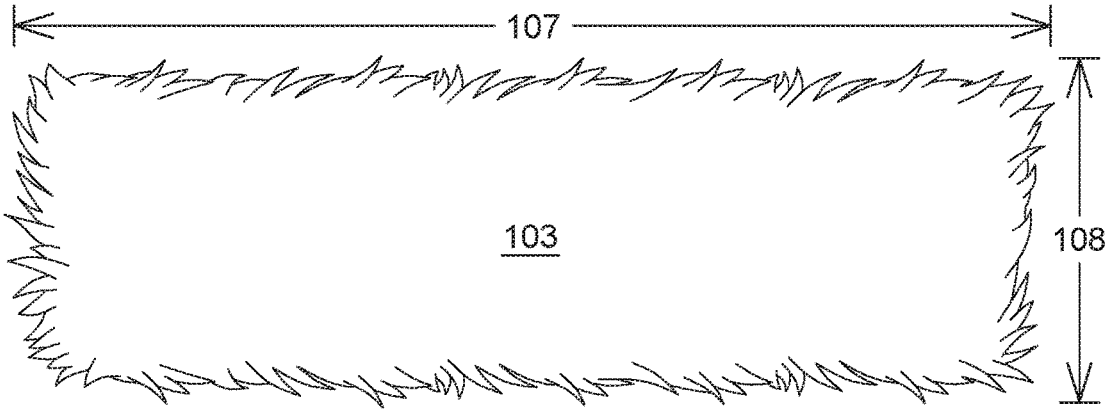
FIGS. 2A, 2B and 2C are respective top, bottom and cross-sectional views of a fur accessory according to an embodiment.
Figure 2B:
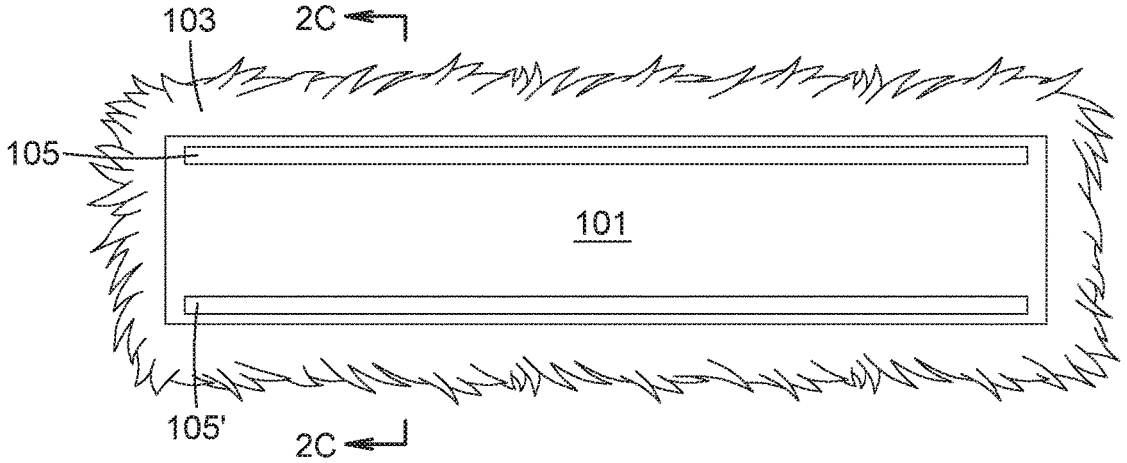
Figure 2C:
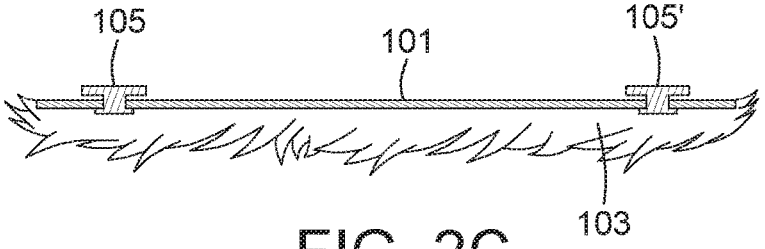

With reference now to FIGS. 2A, 2B and 2C, an accessory 100 is shown according to an embodiment. The accessory 100 comprises a hidden side 101 and an exposed side 103. As can be appreciated, when the accessory 100 is attached to support 3, the hidden side 101 is superposed on the module 1 and is thus hidden from an external view. Likewise, when the accessory 100 is attached to support 3, the exposed side 103 faces away from the module 1 and is thus visible by an external observer.

In the illustrated embodiment, the accessory 100 is a fur accessory, and comprises a decorative material such as fur on the exposed side. As can be appreciated, this decorative material can be suitable, for example, for decorating a collar or a lapel of a coat. The hidden side 101 comprises a support to which fur is attached. In the present embodiment, the support is made of a fabric or mesh suitable for lining a rear side of fur. Attached to the hidden side 101 is an attachment mechanism. In the present embodiment, the attachment mechanism comprises male tracks 105, 105' which extend along a length 107 of the accessory 100. In other embodiments, other attachment mechanisms can be provided.

It is appreciated that the size and appearance of accessory 100 can vary depending on its desired use. In the present embodiment, accessory 100 is designed to decorate a coat collar/lapel and has a length 107 of approximately 13 inches, while being substantially rectangular. Although in the present embodiment the accessory 100 is substantially rectangular, it can alternatively be tapered along its length to better conform to a shape of a lapel which it is destined to cover. In other embodiments, the length and/or width of the accessory 100 can vary, for example if it is intended to cover a different portion of a garment, such as a hood. Moreover, in some embodiments, the accessory 100 can completely form a detachable part of the garment. For example, accessory 100 can be a detachable hood.

Although in the present embodiment accessory 100 is a fur accessory and comprises natural fur such as fox, beaver, coyote lynx, racoon, and the like, it should be appreciated that other types of decorative material are also possible. For example, accessory 100 can comprise decorative materials such as leather, shearling, and other man made materials such as faux fur. Similarly, the color and pattern of decorative material can vary. In this fashion, a user can customize their look by selecting an accessory 100 with an appropriate pattern and/or decorative material to decorate their garment.

Advantageously, the fur accessory 100 can be manufactured in a predetermined set of generic sizes and configurations, and does need not be specifically tailored to the dimensions of a particular garment. Instead, the attachment assembly 1 can be customized to fit a portion of a garment, and a generically-sized fur accessory 100 can be attached to the assembly 1. In this fashion, fur accessory 100 is universally attachable to garments via attachment assembly 1, with the attachment assembly 1 acting as an interface or adapter.

As can be appreciated, when the fur accessory 100 is attached to the support 3, it can serve to decorate the garment while also hiding the attachment module 1 underneath. As illustrated in FIGS. 1A and 1B, when the accessory 100 is attached to the support 3, the hidden side 101 is superposed on the outer side 11 of top panel 5. The accessory 100 is preferably sized (i.e. has a sufficiently large area, and is continuous without holes or apertures) such that it completely, or nearly completely, covers the top panel 5 and/or support 3 thereunder when it is attached to the support 3. In other words, accessory 100 (and by extension hidden side 101 of accessory 100) preferably has a surface area at least equal to or greater than a surface area of the top panel 5 and/or entire support 3. Preferably still, the accessory 100 (and/or hidden side 101) has a length 107 and/or a width 108 greater than or equal to a corresponding length 2 and/or width 4 of top panel 5 and/or entire support 3.

Figure 3:
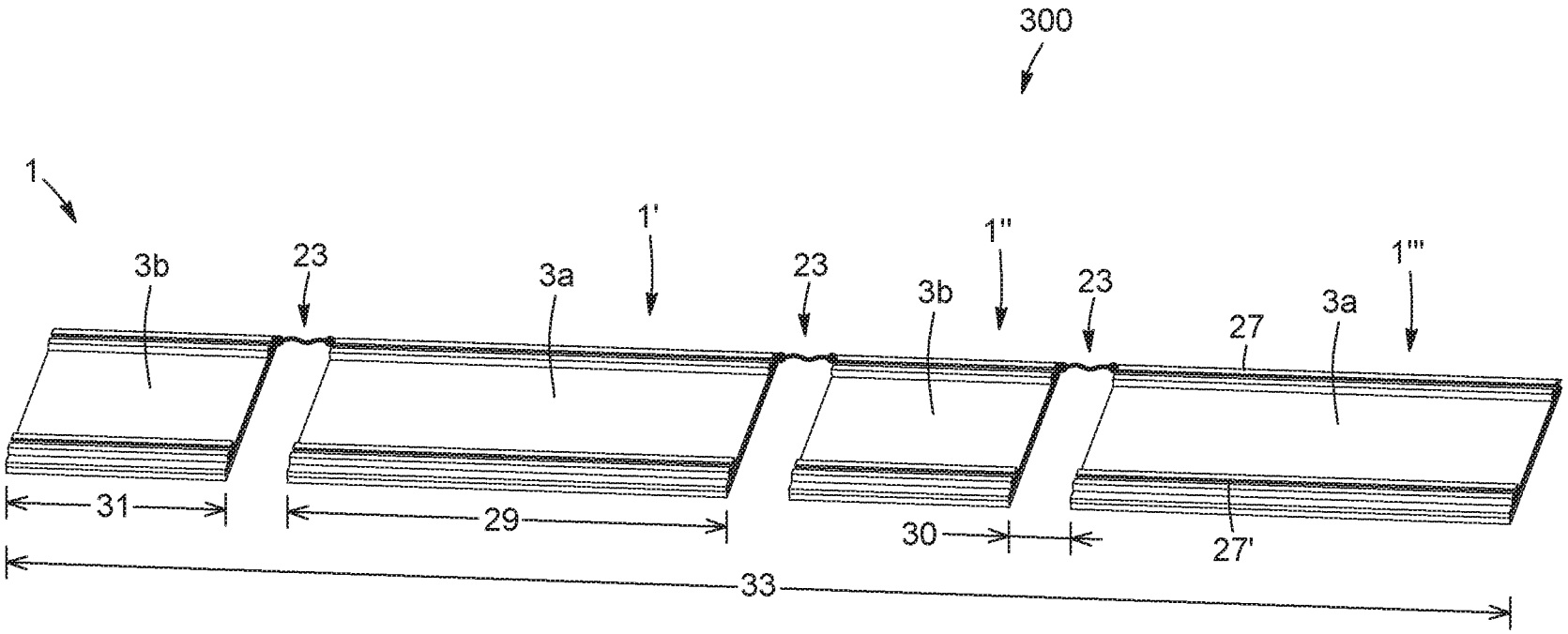
FIG. 3 is a schematic of an attachment assembly comprising several supports tethered together.
Figure 4A:
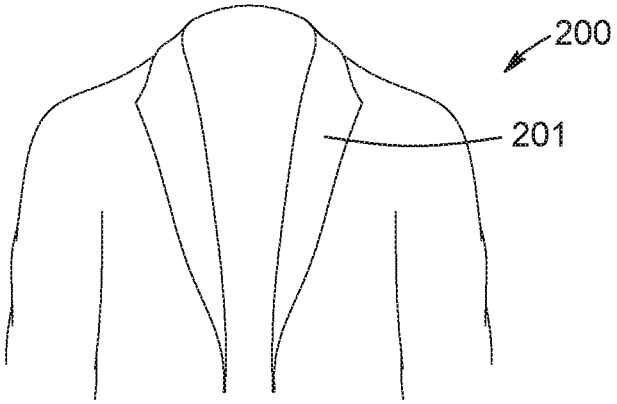
FIGS. 4A to 4E are schematics illustrating a method for attaching a fur accessory to a coat lapel using the attachment assembly of FIG. 3.
Figure 4B:
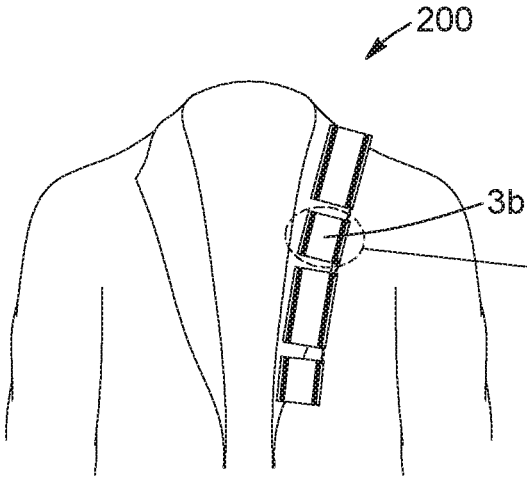
Figure 4C:
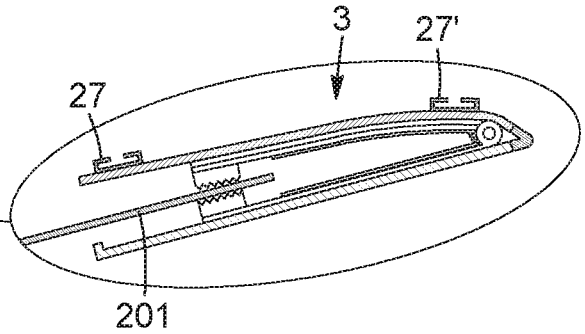
Figure 4D:
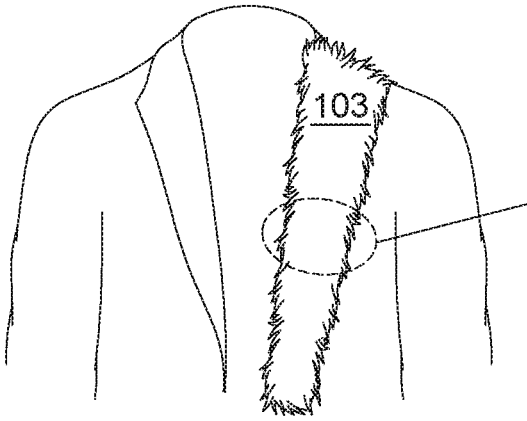
Figure 4E:
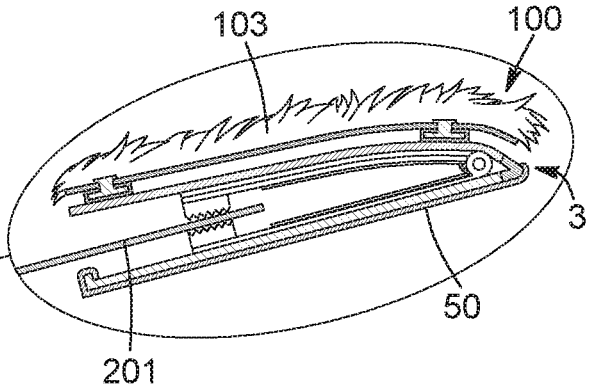

With reference to FIG. 3, several modules 1, 1', 1", 1''' can be attached together in order to form an attachment assembly 300, allowing for a length 33 of the attachment assembly to be adjusted to fit a length of the portion of the garment to which it will be attached. Preferably, the support 3 of each module 1-1''' comprises a connecting mechanism or coupling 23, such as a flexible tether or clasp for example. In the present embodiment, the connecting mechanism includes a flexible tether 25 which can be attached to an adjacent support 3, and preferably allow adjacent supports 3 to be connected end-to-end and spaced apart by a distance 30 such as ¼ inch. In this configuration, each support 3 segment can be angled, pivoted or rotated relative to an adjacent segment, allowing the assembly 300 to conform to a curvature of a portion of a garment, while maintaining a maximum spacing 30 between ends 6, 8 of adjacent supports 3. It should be appreciated, however, that other connecting mechanisms 23 are also possible. For example, connecting mechanism can include a flexible, stretchable, or semi-rigid piece of plastic, metal or rubber, which can maintain the distance 30 between adjacent supports segments 3, while allowing each segment 3 to bend and/or rotate relative to one another. Preferably, the coupling 23 is positioned to allow several supports 3 to be connected in series in an end-to-end configuration. Preferably still, the coupling 23 is positioned proximate an end of the support 6, 8, and proximate the hinge 9. As can be appreciated, coupling 23 can be positioned elsewhere while preferably maintaining supports 3 in an end-to-end configuration, and preferably such that their tracks 27 are aligned. In this fashion, after sliding track 105 of accessory 100 completely through the track 27 of a first module 1, the accessory 100 will be positioned to continue to slide through the track 27 of adjacent module 1'. This can allow the accessory 100 to be easily attached to each one of the modules 1-1''' of the assembly 300. In an embodiment, the track 27 of the last module 1''' can be closed and/or can include a stopper. In this fashion, once track 105 of accessory 100 has been slid through tracks 27 of all modules 1-1''', it will be blocked and/or obstructed from sliding past the far end of the last module 1'''.

In the illustrated embodiment, the supports 3 are provided in two predetermined lengths. Large supports 3*a* are provided, having a length 29 of approximately 4 inches. Small supports 3*b* are also provided, having a length 31 approximately half that of the large support 3*a*, i.e. approximately 2 inches. By providing supports 3*a*, 3*b* in two predetermined sizes, a user can pick and choose a combination of individual support sizes in order to assemble an attachment assembly 300 of a desired length 33. For example, in the present embodiment, the desired length 33 is 13 inches to match that of the fur accessory 100. Two large supports 3*a* are therefore attached to two small supports 3*b*. The total length of supports 3*a*, 3*b* and distance 30 between them add up to a total length 33 of approximately 12.75 inches. This length 33 adequately approximates the desired size of 13 inches, and can provide sufficient support to attach accessory 100.

With reference to FIGS. 4A to 4E, once the attachment assembly 1 has been assembled, each support 3 can be engaged with a portion 201 of a garment 200, in this case the portion 201 being a lapel or collar of a coat 200. Once the supports 3 are secured to the lapel 201, fur accessory 100 can be successively slid in the tracks of each of the supports 3, thereby fully covering the lapel 201 and the module 1 and giving the appearance that the coat 200 was manufactured with the fur accessory 100. Flexible shell 50 can further be attached to the bottom panel 7, providing a fashionable design on an underside of the lapel 201. If a user wishes to alter the appearance of the coat 200, they need only slide out fur accessory 100 and/or remove shell 50, and attach a new accessory 100 and/or shell 50.

As discussed above, attachment assembly 300 can serve to attach accessory 100 to other portions of a garment as well. With reference to FIGS. 5A, 5B and 5C, attachment assembly 300 is shown in an embodiment where it is used to attach a fur trim accessory 100 to a hood 201 of a coat 200. Once attachment assembly 300 is assembled, each support 3 can be engaged with the hood 201. The fur accessory 100 can then be slid in the tracks of the supports 3, engaging with tracks on the top and bottom panels 5, 7 of the supports 3. In this fashion, the fur trim 100 envelopes the supports 3 and thereby envelops the perimeter of the hood 201, giving the appearance that the fur trim 100 is sewn onto the hood 201. As can be appreciated, given the universal attachment characteristics of the attachment assembly 300, the attachment assembly 300 can be used to attach a fur trim to hoods on a wide variety of coats. Moreover, the assembly 300 can be used to replace a hood trim already existing on a coat. For example, the user can remove the existing trim of a coat and use the assembly 300 to attach a new fur trim accessory 100. In some embodiments, if the existing trim is thin and/or small enough, the supports of assembly 300 can simply be clamped over the existing trim, allowing a new fur trim 100 to be attached without removing the existing trim.

Although not explicitly mentioned, other advantages may also become apparent to one skilled in the art upon reading the present disclosure. Moreover, the configurations described herein are but some possible embodiments for the present invention. Other useful embodiments or configurations may be apparent to one skilled in the art upon reading the present disclosure.

The invention claimed is:

1. A garment attachment assembly for attaching an accessory to a garment, the accessory having an exposed side and a hidden side, the garment attachment assembly comprising a plurality of garment attachment modules, each garment attachment module comprising:

an elongated support member extending between first and second ends, and having an outer side and an inner side;

a garment attachment provided on the inner side to removably secure the inner side of the support member on a portion of the garment, wherein the garment attachment includes a clamp;

an accessory attachment provided on the outer side to removably secure the hidden side of the accessory on the outer side of the support member; and a coupling mechanism in at least one of the first and second ends of the support member, for coupling the first or second end of the support member to the first or second end of the support member of an adjacent garment attachment module, whereby coupling adjacent garment attachment modules allows adjusting an overall length of the garment attachment assembly to fit a length of the portion of the garment.

2. The garment attachment assembly according to claim 1, wherein the coupling mechanism comprises a flexible tether extending between the garment attachment module and an adjacent garment attachment module, thereby allowing the garment attachment module and the adjacent garment attachment module to pivot relative to one another while maintaining a maximum separation distance between their ends.

3. The garment attachment assembly according to claim 2, wherein the tether comprises a stretchable material.

4. The garment attachment assembly according to claim 1, wherein the coupling mechanism is positioned to maintain the accessory attachment in the garment attachment module in alignment with the accessory attachment in the adjacent garment module.

5. The garment attachment assembly according to claim 1, wherein the accessory attachment comprises a track member for slideably engaging with a corresponding track member on the hidden side of the accessory.

6. The garment attachment assembly according to claim 5, wherein the track member comprises a male or a female rail extending lengthwise along the outer side of the support member between the first and second ends, for slideably engaging with a corresponding male or female track member on the hidden side of the accessory.

7. The garment attachment assembly according to claim 6, wherein the rail is open in at least the first or second end for initiating the slideable engagement with the track member on the hidden side of the accessory.

8. The garment attachment assembly according to claim 6, wherein the male or female rail is closed in the first or second end, thereby obstructing the track member on the hidden side of the accessory from sliding along the rail past the first or second end.

9. The garment attachment assembly according to claim 1, wherein the elongated support member is a top panel, and the garment attachment module further comprises a bottom panel foldable relative to the top panel via a hinge.

10. The garment attachment assembly according to claim 9, wherein the top and bottom panels have respective inner and outer sides, and wherein the top and bottom panels are foldable along the hinge between an open position where the top and bottom panels extend away from one another, and a closed position in which the top and bottom panels extend substantially parallel to one another with the inner sides of the top and bottom panels facing one another.

11. The garment attachment assembly according to claim 10, further comprising a biasing mechanism operatively connected to the top and bottom panels to bias the top and bottom panels towards the closed position.

12. The garment attachment assembly according to claim 10, further comprising an accessory attachment on the outer side of the bottom panel.

13. The garment attachment assembly according to claim 10, wherein the clamp is positioned between the top and bottom panels when in the closed position.

14. The garment attachment assembly according to claim 1, wherein a length of at least one of the garment attachment modules differs from a length of at least another one of the garment attachment modules coupled thereto.

15. The garment attachment assembly according to claim 1, wherein the support member is made from a rigid plastic.

16. A garment attachment module of a garment attachment assembly for attaching an accessory to a garment, the accessory having an exposed side and a hidden side, the garment attachment module comprising:

an elongated support member extending between first and second ends, and having an outer side and an inner side;

a garment attachment provided on the inner side to removably secure the inner side of the support member on a portion of the garment, wherein the garment attachment includes a clamp;

an accessory attachment provided on the outer side to removably secure the hidden side of the accessory on the outer side of the support member; and a coupling mechanism in at least one of the first and second ends of the support member, for coupling the first or second end of the support member to the first or second end of a support member of an adjacent garment attachment module, whereby coupling the adjacent garment attachment module allows adjusting an overall length of the garment attachment assembly to fit a length of the portion of the garment.

17. The garment attachment module of claim 16, wherein the accessory attachment is configured to attach the accessory directly to the garment.

* * * * *